US010775099B1

(12) United States Patent
Bharadwaz et al.

(10) Patent No.: US 10,775,099 B1
(45) Date of Patent: Sep. 15, 2020

(54) REFRIGERATOR WITH A SHELF

(71) Applicant: WHIRLPOOL CORPORATION, Benton Harbor, MI (US)

(72) Inventors: Angshuman Bharadwaz, Toledo, OH (US); Devidas B. Raskar, Benton Harbor, MI (US); Lorraine J. Westlake, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/552,666

(22) Filed: Aug. 27, 2019

(51) Int. Cl.
*F25D 25/02* (2006.01)
*F25D 27/00* (2006.01)

(52) U.S. Cl.
CPC ..... *F25D 25/025* (2013.01); *F25D 27/00* (2013.01); *F25D 2325/022* (2013.01); *F25D 2327/00* (2013.01)

(58) Field of Classification Search
CPC ..... F25D 25/02; F25D 25/025; F25D 27/00; F25D 2327/00; F25D 2325/022
See application file for complete search history.

(56) References Cited

U.S. PATENT DOCUMENTS 5,273,354 A * 12/1993 Herrmann ..... A47B 96/025 312/408
6,786,562 B2 * 9/2004 Obrock ..... C03B 23/033 211/153
6,811,045 B1 11/2004 Masker et al.
7,163,305 B2 1/2007 Bienick
8,286,561 B2 10/2012 Driver et al.
8,375,746 B2 2/2013 Picken et al.
D694,292 S 11/2013 Eby et al.
8,590,334 B2 11/2013 Kim et al.
8,596,205 B2 12/2013 Driver et al.
9,179,773 B2 11/2015 Driver et al.
9,207,012 B2 12/2015 Driver et al.
9,429,354 B2 8/2016 Ha et al.
9,532,649 B2 1/2017 Driver et al.
10,130,176 B2 11/2018 Driver et al.
10,317,129 B2 * 6/2019 Curdt ..... F25D 25/02
10,471,430 B2 * 11/2019 Le Berre ..... B01L 3/5088
2004/0062031 A1 * 4/2004 Pinter ..... A47B 96/02 362/612
2008/0236183 A1 * 10/2008 Iimura ..... F25D 25/02 62/264
2009/0155566 A1 * 6/2009 Gentleman ..... C23C 30/00 428/312.8

(Continued)

FOREIGN PATENT DOCUMENTS

WO 16092576 A1 6/2016

OTHER PUBLICATIONS

GE Refrigerator Spill Proof Glass Shelf, https://picclick.com/GE-Refrigerator-Spill-Proof-Glass-Shelf-Measures-231396865554.html, accessed Aug. 8, 2019.

*Primary Examiner* — Daniel J Rohrhoff
(74) *Attorney, Agent, or Firm* — McGarry Bair PC

(57) ABSTRACT

A refrigerator includes at least one compartment having an open face. A closure is movable relative to the open face to selectively close the open face. At least one glass shelf is provided within the compartment. The at least one glass shelf has an upper surface. A contour can at least partially bound an area within the upper surface.

20 Claims, 9 Drawing Sheets

(56) References Cited

U.S. PATENT DOCUMENTS

| | | | | |
|---|---|---|---|---|
| 2011/0148268 | A1* | 6/2011 | Driver | F25D 25/02<br>312/408 |
| 2012/0216880 | A1* | 8/2012 | Nall | C03C 15/00<br>137/312 |

* cited by examiner

REFRIGERATOR WITH A SHELF

BACKGROUND

In a refrigerator or other appliance for storing food substances and containers of food substances, which can be found within a kitchen environment, garages, bars, restaurants, and other places, there can be numerous containers of various types, sizes, and shapes that are configured to store all matter of food substances and food items. Such a refrigerator can include a cabinet defining an interior, which can be provided as a compartment having an open face. The cabinet can include at least a pair of opposing side walls.

At least one shelf can be provided within the refrigerator for supporting food items and containers of food substances to be stored within the refrigerator. If a food item or container stored within the refrigerator leaks or spills, a food substance or liquid can gather on the shelf and cause a mess which can reach other food items or containers and can be a nuisance for a user to clean.

BRIEF SUMMARY

In one aspect, the present disclosure relates to a refrigerator comprising at least one compartment having an open face, a closure movable relative to the open face to selectively close the open face, at least one annealed glass shelf provided within the compartment and having an upper surface, and at least one continuous, raised bead of ceramic paint provided on the upper surface and defining a contour at least partially bounding an area within the upper surface.

In another aspect, the present disclosure relates to a refrigerator comprising at least one compartment having an open face, a closure movable relative to the open face to selectively close the open face, at least one glass shelf provided within the compartment and having an upper surface, and at least one continuous, raised bead provided on the upper surface and defining a contour at least partially bounding an area within the upper surface.

DETAILED DESCRIPTION

Figure 1:
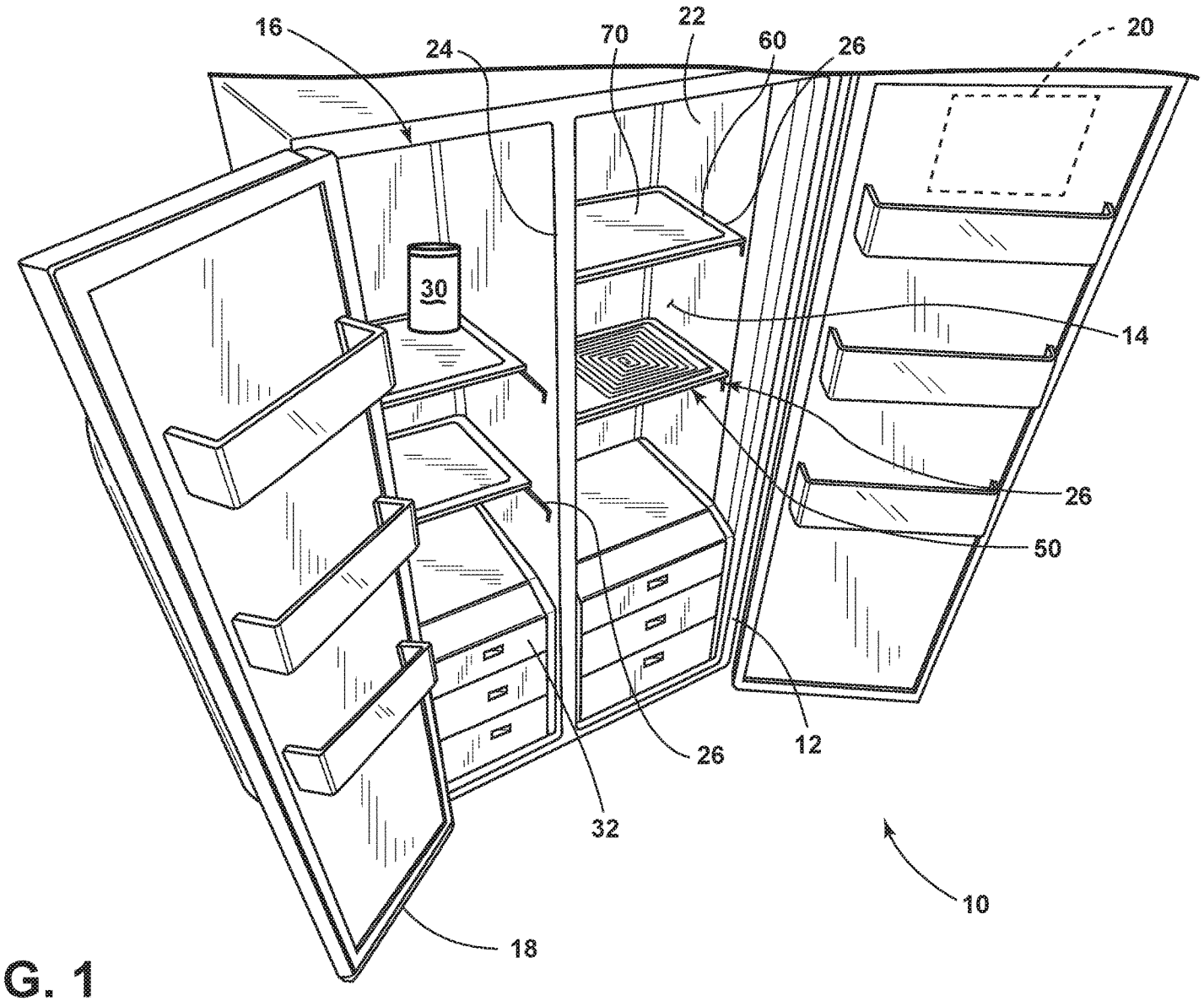
FIG. 1 illustrates a perspective view of a refrigerating appliance in the form of a refrigerator having at least one shelf according to an aspect of the present disclosure.

FIG. 1 illustrates a refrigerating or food storage appliance or refrigeration apparatus, illustrated herein as a refrigerator 10, that can be provided within a storage and consumption environment, such as a kitchen. The refrigerator 10 comprises a cabinet 12 at least partially defining an interior, illustrated herein as at least one compartment 14, that can hold a plurality of containers 30 or other food items. Each of the at least one compartments 14 can include and at least partially define an open face 16, which can also function as an access opening to the compartment 14, as well as a closure, illustrated herein as a door 18, that further at least partially defines the compartment 14 when the door 18 selectively closes the open face 16.

The door 18 is coupled to or movably mounted to the cabinet 12 and configured to be movable relative to the open face 16 between an opened position as shown and a closed position (not shown), so as to selectively open or close the open face 16, respectively, and to selectively provide access into the compartment 14 through the open face 16. By way of non-limiting example, the door 18 can be rotatable between the closed position and the opened position relative to the cabinet 12, and further the door 18 can be hingedly coupled to the cabinet 12 for movement between the opened position and the closed position.

As illustrated herein, the refrigerator 10 can include side-by-side compartments 14 at least partially defined by side walls 22 and separated by a center partition or center wall 24, though it will be understood that upper and lower compartments 14 can also be included. By way of non-limiting example, both of the compartments 14 can be provided as refrigerator compartments 14, such as with an optional lower portion, which can further optionally include drawers 32, being provided as a freezer compartment 14, or the side-by-side compartments 14 can comprise one refrigerator compartment 14 and one freezer compartment 14, the compartments 14 closable by the doors 18. The compartments 14 can be cooled to different temperatures by operation of a refrigeration system. The temperature differential between the compartments 14 can be maintained through separation of the compartments 14 by the intervening insulated partition, herein the center wall 24.

The number and arrangement of refrigerated compartments 14, either a chilled compartment 14 or a freezing compartment 14, are not germane to the present disclosure and are given by way of non-limiting example in order to illustrate one possible environment. While the refrigerating appliance is illustrated as a side-by-side, front-opening refrigerator 10, the aspects of the present disclosure can have applicability in other refrigerating appliances, non-limiting examples of which include stacked style freezer-on-top or freezer-on-bottom refrigerators, drawer-style refrigerators or freezers, beverage coolers, free-standing refrigerators, build-in refrigerators, display refrigerators, etc.

The compartment 14 can include shelf rails or shelf guides 26 that can be attached to at least the side walls 22 and the center wall 24. As illustrated herein, one shelf guide 26 on the side wall 22 can be sized and positioned so as to be complementary with another shelf guide 26 on the center wall 24, so as to comprise a pair of opposing shelf guides 26. At least one shelf 50 can be provided within the compartment 14 such that each pair of opposing shelf guides 26 can support an individual shelf 50. In addition, or alternatively, the shelf 50 can be provided such that a drawer 32 is slidably mounted directly beneath the shelf 50, with the shelf 50 selectively closing an open top of the drawer 32. The shelves 50 can be adapted for slidable, tiltable, a combination thereof, or any other suitable type of movement, out of and into the compartment 14.

Each shelf 50 can comprise a support element 70 and a frame element 60. The support element 70 can be at least partially planar. The frame element 60 can be provided about, and optionally at least partially surrounding, at least a portion of the periphery of the support element 70. By way of non-limiting example, the frame element 60 can be provided as a continuous frame or as separate brackets or frame members, and can retain, support, encapsulate, be overmolded to, or surround at least a portion of the periphery or the perimeter of the support element 70. The frame element 60 can be provided along at least one peripheral edge of the support element 70, and can be provided along all of the peripheral edges of the support element 70. The support element 70 is illustrated herein as a glass shelf, though it will be understood that other materials can be included, such as a plastic. The frame element 60 can be formed of any suitable material, non-limiting examples of which include plastic or metal.

The shelf 50, and in particular the support element 70, is configured to provide a support surface upon which food items and containers 30 can be placed to be stored and refrigerated. The containers 30 can be any sort of container 30 for holding a food substance. The containers 30 can be commercially available containers 30 that are obtained by a user already containing a food substance, or storage containers 30 into which a food substance is placed by a user for refrigerated storage outside of the original packaging. Containers 30 can be transparent or opaque, with any suitable level of opacity being contemplated. The food substance within the containers 30 can be any food substance, non-limiting examples of which include liquids, solids, gelatinous substances, mixtures, dry goods, etc. In one example, the containers 30 are used to contain food substances that are non-solid, non-limiting examples of which can include milk, juices, other beverages, ketchup, other condiments, mayonnaise, jellies, sauces, creams, etc.

The refrigerator 10 further comprises a control assembly, illustrated herein as a controller or a control unit 20, for controlling the operation of the refrigerator 10 and coupled with various working components of the refrigerator 10 to control the operation of the working components and to implement cycles of refrigeration. While the control unit 20 is illustrated herein as being provided within the door 18, it will be understood that any suitable location can be used for the control unit 20, including within the cabinet 12 rather than within the door 18. The control assembly can further include a user interface (not shown) that can be operably coupled with the control unit 20 and can provide an input and output function for the control unit 20.

Other communications paths and methods can also be included in the refrigerator 10 and can allow the control unit 20 to communicate with a user in a variety of ways. For example, the control unit 20 can be configured to send a text message to the user, send an electronic mail to the user, or provide audio information to the user either through the refrigerator 10 or utilizing another device such as a mobile phone.

The control unit 20 can include a machine controller and any additional controllers provided for controlling any of the components of the refrigerator 10. For example, the control unit 20 can include the machine controller and a refrigeration system controller. Many known types of controllers can be used for the control unit 20. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the refrigerator 10.

Figure 2:
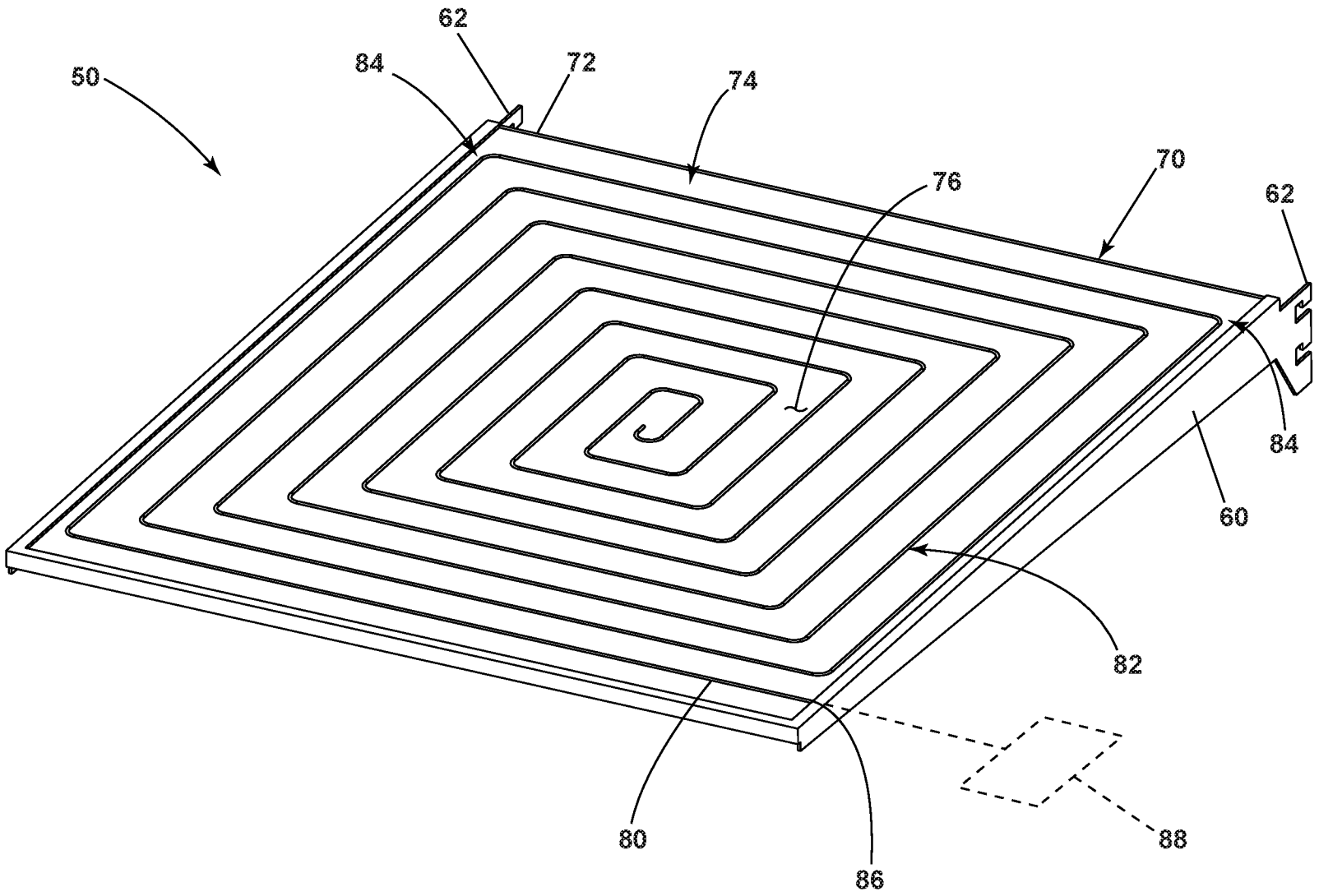
FIG. 2 illustrates a perspective view of a shelf that can be provided within the refrigerator of FIG. 1.

Referring now to FIG. 2, the shelf 50 includes the support element 70, which can be a glass shelf, that is coupled with and at least partially received by the frame element 60. The frame element 60 can include at least one mounting structure 62 that serves to couple the shelf 50 with the cabinet 12 for improved stability and durability. Alternately, it will be understood that the frame element 60 can be provided without the mounting structure 62, such that the opposing shelf guides 26 can provide for coupling the shelf 50 within the compartment 14 and are configured for the frame element 60 to rest on, to be supported by, or to be slidably or otherwise received by the shelf guides 26, without an additional mounting structure 62.

The support element 70 comprises a peripheral edge 72 and an upper surface 74. The peripheral edge 72 of the support element 70 defines a boundary of the support element 70 and is at least partially received by the frame element 60. The upper surface 74 in particular defines the support surface or receiving surface upon which food items and containers 30 can be placed for refrigeration or storage. The shelf 50, and in particular the support element 70, further comprise at least one continuous, raised bead 80 that can be provided on the upper surface 74. The at least one continuous, raised bead 80, or a plurality of continuous, raised beads 80, for example, a set of continuous, raised beads 80 or at least one partially continuous, raised bead 80 including at least one gap or break within the continuous, raised bead 80, can collectively define a contour 82 that can extend across at least a portion of the upper surface 74.

The contour 82 can extend across any desired portion, proportion, or percentage of the surface area of the upper surface 74, and in any desired pattern, such that the contour 82 at least partially bounds at least one area 76 within the upper surface 74. The contour 82 can be positioned within or interiorly of the peripheral edge 72, though it will be understood that the contour 82 can extend up to, adjacent to, or terminate at the peripheral edge 72. The contour 82 can comprise any suitable closed loop pattern or open loop pattern. In the present example, the contour 82 comprises an open loop pattern provided more specifically as a spiral-shaped open loop contour 82. The contour 82 is considered to be an open loop contour 82 based on its inclusion of at least one open end or open channel 84. In this way, the open loop contour 82 does not completely bound the area 76 within the upper surface 74 and the at least one area 76 is not completely fluidly isolated from the peripheral edge 72 by the open loop contour 82. In addition, in the open loop contour 82, the continuous, raised bead 80 can be provided as a single continuous, raised bead 80 forming the entire open loop contour 82, though it will be understood that it can alternatively be more than one continuous, raised bead 80 that forms the open loop contour 82.

Figure 3:
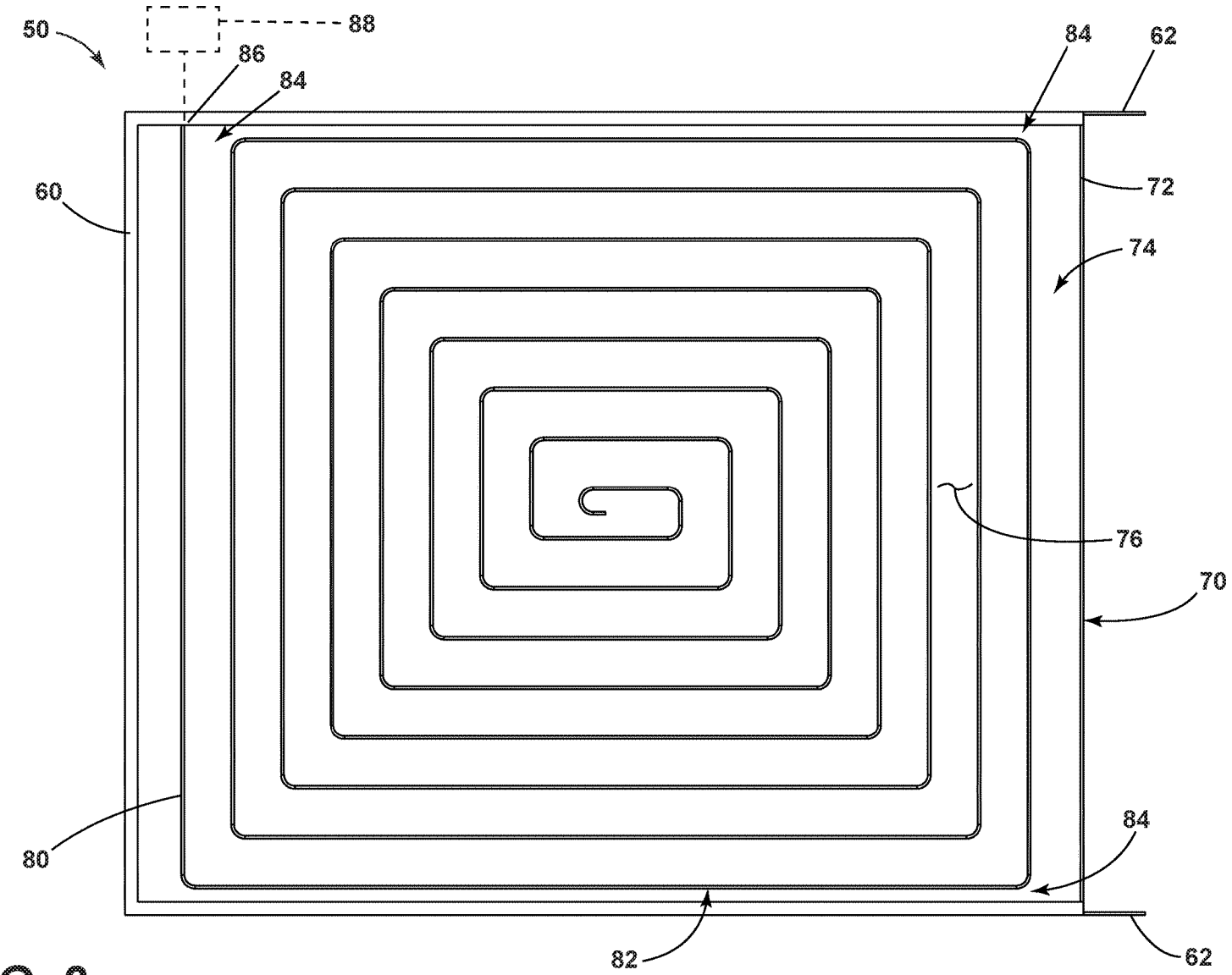
FIG. 3 illustrates a top view of the shelf of FIG. 2.

Referring now to FIG. 3, the open loop contour 82 of this example includes at least one open channel 84 fluidly coupling the area 76 with the peripheral edge 72. The open loop contour 82 further includes a contact point 86 where the continuous, raised bead 80 terminates at the peripheral edge 72. The contact point 86 can comprise an exposed end 86 of the continuous, raised bead 80 where it terminates at the peripheral edge 72. It can also be seen that the open loop contour 82 extends across at least the majority of the upper surface 74 and is distributed uniformly across the upper surface 74. Further, while the open loop contour 82 is illustrated herein as a substantially rectangular-shaped concentric pattern with rounded corners, it will be understood that any suitable shape profile can be used for the contour 82, including a completely rectangular-shaped concentric pattern or a circular spiral-shaped pattern.

In one example, the continuous, raised bead 80 can comprise and be formed by a ceramic paint that is applied to the upper surface 74 as the continuous, raised bead 80. The ceramic paint can be an ideal substrate for forming the continuous, raised bead 80 as it is highly durable and has high resistance to abrasion due to strong bonding between the continuous, raised bead 80 of ceramic paint and the glass support element 70. With containers 30 and even pots and pans being placed on the shelves 50 within the refrigerator 10, the use of a material with improved abrasion resistance to sliding of abrasive surfaces, such as containers 30, compared to that of other types of paints or adhesives can be an improvement. However, it will be understood that any other suitable type of paint, material, or adhesive can be used to form the continuous, raised bead 80.

In the case that ceramic paint is used to form the continuous, raised bead 80, the ceramic paint can be applied to an annealed glass shelf or glass support element 70 that has not yet been tempered. The tempering of the annealed glass shelf after the application of the ceramic paint continuous, raised bead 80 further improves durability of the continuous, raised bead 80 because bonding between the glass support element 70 and the ceramic paint continuous, raised bead 80 is further promoted during the tempering process as the ceramic paint is heat cured onto the glass support element 70. However, it will be understood that any suitable type of paint, material, or adhesive that can be used to form the continuous, raised bead 80 can be used, whether or not the material is cured by heat to form the continuous, raised bead 80.

In another example, the continuous, raised bead 80 comprises and is formed by at least one optical glass fiber, such as optical glass fibers comprising silica. The optical glass fiber can be applied to the glass support element 70 to form the continuous, raised bead 80 using an adhesive to adhere the optical glass fiber continuous, raised bead 80 to the glass support element 70, or the optical glass fiber continuous, raised bead 80 can be at least partially embedded within the glass support element 70.

When optical glass fiber is used to form the continuous, raised bead 80, the optical glass fiber continuous, raised bead 80 can further be configured to provide illumination to the continuous, raised bead 80, and therefore also to the shelf 50. By operably coupling the optical glass fiber continuous, raised bead 80 with at least one light source 88, the optical glass fiber continuous, raised bead 80 can be illuminated. In one example, the exposed end 86 of the optical glass fiber continuous, raised bead 80 can function as the contact point 86 for operably coupling the optical glass fiber continuous, raised bead 80 with the light source 88. The optical glass fiber continuous, raised bead 80 can be coupled directly with the light source 88, which can in turn be operably coupled with the control unit 20, or the optical glass fiber continuous, raised bead 80 can be operably coupled with the light source 88 via the control unit 20, by way of wired or wireless communication, or a combination of both. In one example, when the continuous, raised bead 80 is formed from a single optical glass fiber defining the entire open loop contour 82, the entire open loop contour 82 can be illuminated by the use of a single light source 88 coupled with the single optical glass fiber continuous, raised bead 80.

By way of further non-limiting example, the control unit 20 can be programmed to provide power to the light source 88, and thus also to the optical glass fiber continuous, raised bead 80 in response to the occurrence of a predetermined trigger event, non-limiting examples of which include the opening or closing of the door 18, the door 18 remaining opened for a predetermined period of time, a user input or request, or a timer-based trigger event. In this way, the optical glass fiber continuous, raised bead 80 can be configured to be illuminated at any desired time based on user input, or, for example, can be automatically illuminated when the door 18 of the refrigerator 10 is opened. The illumination of the optical glass fiber continuous, raised bead 80 can comprise illumination of the visible light spectrum, including illumination in at least one color or in a variety of different colors that can be selectable, and/or can comprise ultraviolet (UV) illumination. When UV illumination is provided, it is contemplated that the UV illumination can additionally provide a freshness feature or function to the refrigerator 10.

Any suitable number of light sources 88 can be provided within the refrigerator 10, from a single light source 88 to a plurality of light sources 88 that can be arranged throughout the refrigerator 10 and coupled with any of or with all of the shelves 50 to provide illumination for the shelves 50. The light sources 88 can be positioned such that they are aligned to be operably coupled with the contact point 86 when the shelf 50 is in an installed position and received within the compartment 14 by the shelf guides 26. The shelves 50 and the light sources 88 can be provided and positioned such that only shelves 50 within a predetermined area within the refrigerator 10 are illuminated, or they can be positioned such that all of the shelves 50 within the refrigerator 10 are illuminated.

In the case that only a predetermined area of the shelves 50 are adapted to be illuminated by coupling of the optical glass fiber continuous, raised bead 80 with at least one light source 88, non-limiting examples of such a predetermined area can include a single shelf 50 or specific shelves 50 within the refrigerator 10, or only shelves 50 that are located on the door 18 or in a specific compartment 14 of the refrigerator 10. The shelves 50 within the predetermined area can be predefined to receive containers 30 having specific desired contents. The specific desired contents can be, by way of non-limiting example, programmably defined either by the refrigerator 10 or according to a preference of a user, such as by the user interface that allows the user to designate an area, a compartment 14, or specific shelves 50 as being associated with containers 30 having specific desired contents to be associated with illumination of the shelves 50.

Figure 4:
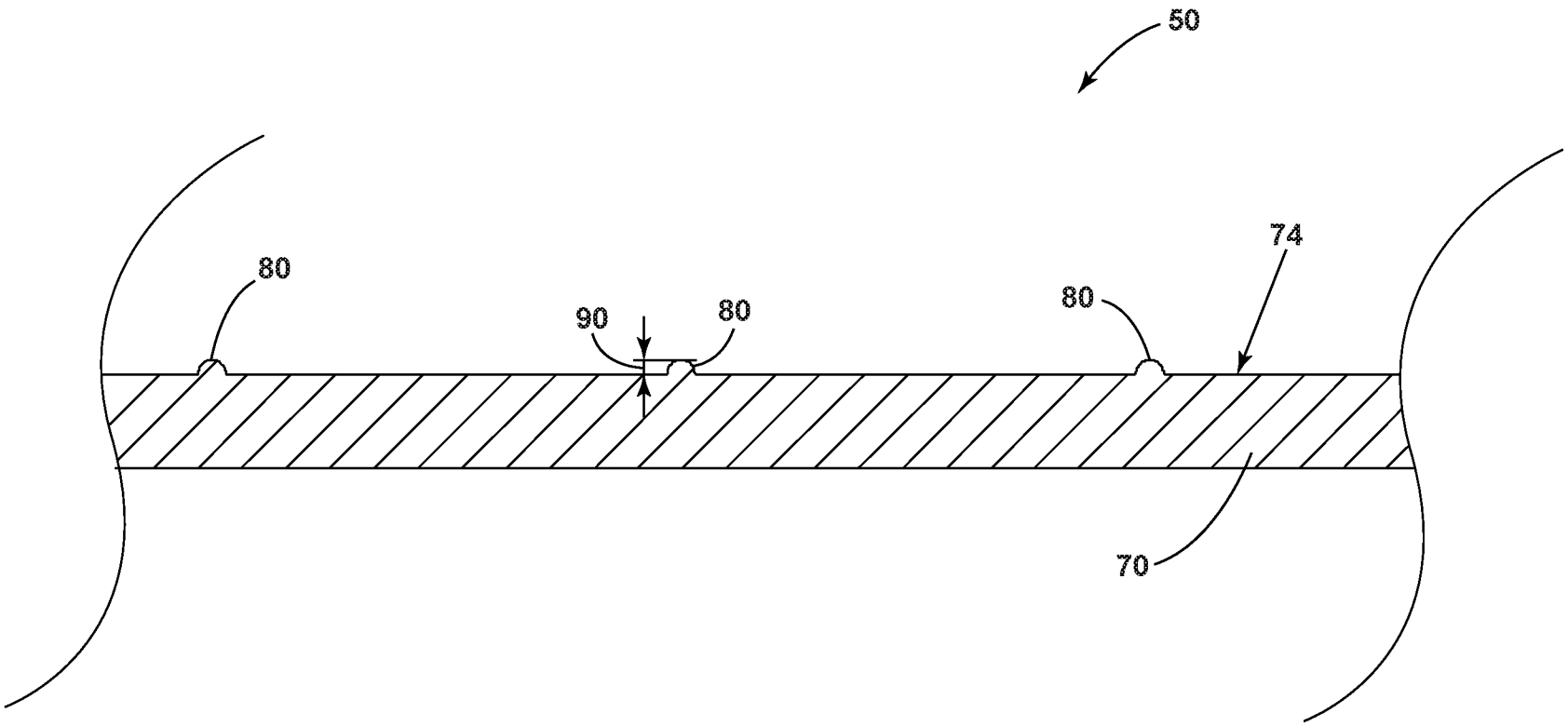
FIG. 4 illustrates a cross-sectional view of the shelf of FIG. 2.

Referring now to FIG. 4, a cross-section of a portion of the shelf 50 illustrates that the continuous, raised bead 80, and thus also the contour 82, is raised relative to and can extend, protrude, or project upwardly from the upper surface 74 to define a vertical height 90 of the continuous, raised bead 80 and of the contour 82 relative to the upper surface 74. The raised height of the contour 82 relative to the upper surface 74 enables the contour 82 to provide a receiving surface for food items and containers 30 that is raised above the upper surface 74, as well as to provide a spill containment or spill guiding function for the shelf 50. The contour 82 is illustrated herein as having a uniform vertical height 90 throughout the entirety of the contour 82 extending across the upper surface 74 of the shelf 50, which may be desired in order to provide a flat, level surface of the contour 82 upon which food items and containers 30 can be placed. Alternately, the vertical height 90 of the contour 82 can vary across the upper surface 74. In one example, the vertical height 90 of the contour can increase steadily and at a uniform rate as the contour 82 moves outwardly from a central portion of the support element 70 towards the peripheral edge 72. In another example, the vertical height 90 of the contour 82 can be uniform throughout the majority of the upper surface 74 and can increase in height only at outermost portions nearest the peripheral edge 72. The vertical height 90, whether uniform or non-uniform and whether at a minimum or a maximum vertical height 90, can be specifically selected such that a predetermined volume of liquid can be contained by the contour 82.

Further, the pattern defined by the contour 82 can be specifically selected to contain, isolate, or guide spills that may occur on the shelf 50. For example, turning now to the function of the open loop contour 82 for the containment of spills that can occur on the shelf 50, because the open loop contour 82 does not completely bound the area 76 and fluidly isolate the area 76 from the peripheral edge 72, the open loop contour 82 is not configured to isolate or contain a spill to a small portion of the area 76 or of the upper surface 74. Instead, the open loop contour 82, and particularly in the spiral-shaped pattern as shown, can function as a raceway for a liquid or substance that is spilled, drawing the spilled liquid along the raceway defined by the contour 82, such as by capillary action. In this way, the spiral-shaped open loop contour 82 is configured to guide the liquid along the open loop contour 82, spreading the liquid out along the open loop contour 82. This provides the benefit that the spill can be guided or directed to spread out along the spiral-shaped length of the open loop contour 82, rather than exceeding the vertical height 90 of the open loop contour 82 and overflowing the open loop contour 82 at any point. This allows the bottoms of containers 30 or food items that are resting upon the contour 82 to remain dry and to not be soiled or wetted, despite the spill on the shelf. This is realized because the pattern of the open loop contour 82 is specifically selected to spread the spilled liquid out, rather than to isolate or contain it, in favor of directing the spilled liquid away from contact with containers 30 as much as possible.

Additionally, or alternatively, it is contemplated that, initially, when a spill occurs, the volume of liquid spilled may be sufficient such that it at least temporarily exceeds the vertical height 90 of the open loop contour 82 at the position of the spill and overflows at least a portion of the open loop contour 82 at the point of the spill. However, as the liquid moves outwardly from the point of the spill, the level of the spill can decrease, such as by a gradual decrease, to a point that the spill volume no longer exceeds the vertical height 90 of the open loop contour 82, and can then guide or direct the spill to spread out along the open loop contour 82 in any suitable direction along the open loop contour 82, as described previously, then allowing the open loop contour 82 to slow the flow of the spill and redirect the spill within the open loop contour 82, rather than allowing the spilled liquid to contact containers 30 resting on the open loop contour 82. Thus, even if the initial spill has a volume sufficient to overflow at least a portion of the open loop contour 82, the open loop contour 82 can still be configured to redirect the spill and slow the spread of at least a portion of the spill as the spill moves throughout the open loop contour 82.

If the open loop contour 82 has a uniform vertical height 90 throughout the upper surface 74, then if the volume of spilled liquid is sufficient such that the entirety of the open loop contour 82 is filled with liquid, the liquid will then flow through the open channels 84 to exit the open loop contour 82. Depending on the extent to which the frame element 60 surrounds the peripheral edge 72, the liquid is then either contained by the frame element 60, but above the level of the vertical height 90 of the open loop contour 82, or the liquid could overflow the peripheral edge 72 and run off of the shelf 50 if the liquid reaches a position on the peripheral edge 72 that is not bounded by the frame element 60. If the open loop contour 82 has a vertical height 90 that increases towards the peripheral edge 72, the increased vertical height 90 can provide additional spill containment ability by increasing the liquid capacity of the open loop contour 82 as compared to the open loop contour 82 having a lower, uniform vertical height 90.

Figure 5:
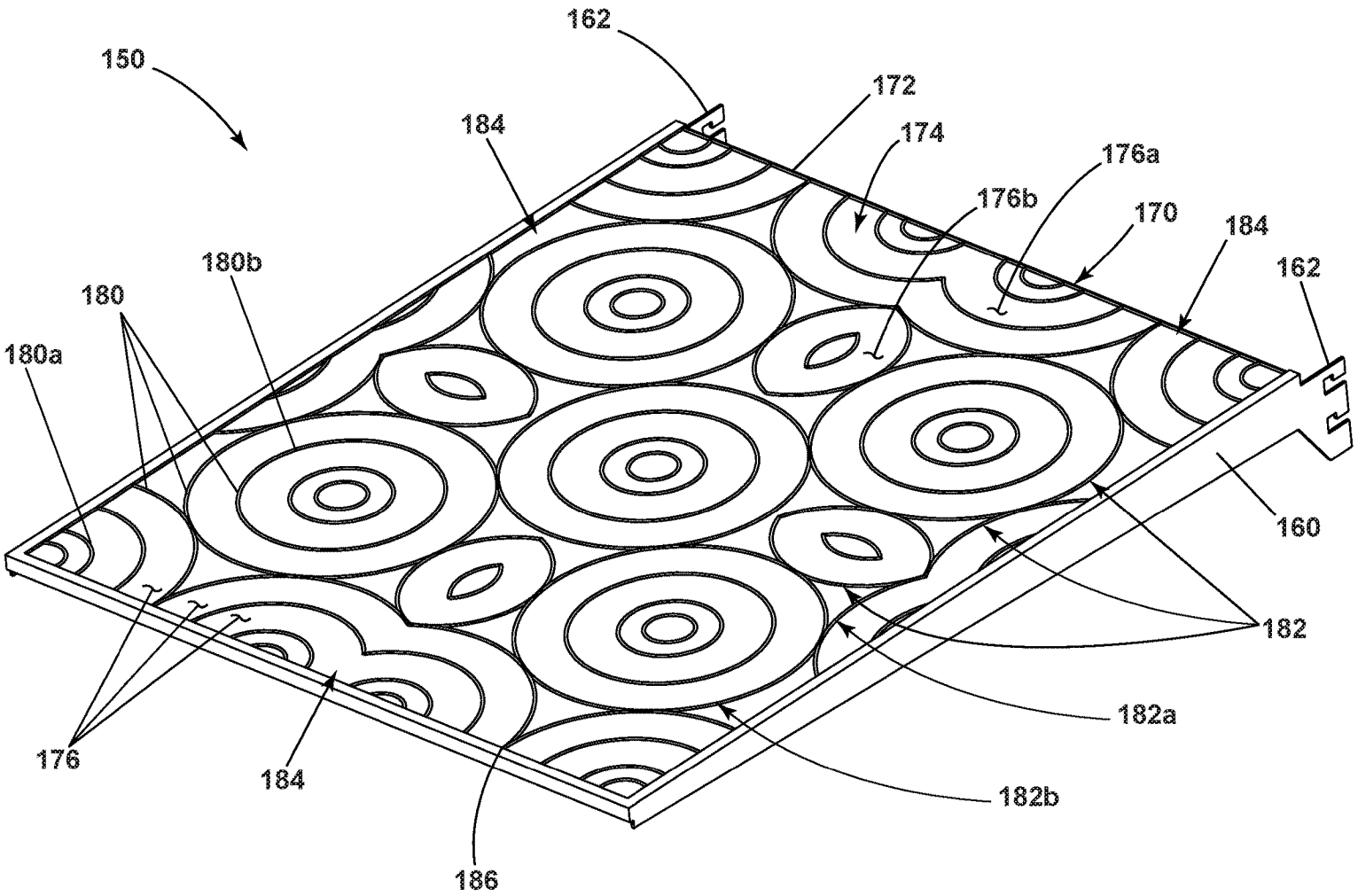
FIG. 5 illustrates a perspective view of another example of a shelf that can be provided within the refrigerator of FIG. 1.

Referring now to FIG. 5, another example of a shelf 150 that can include at least one continuous, raised bead 180 that individually and/or collectively define a contour 182 that can extend across at least a portion of the upper surface 174 is illustrated. The shelf 150 is similar to the first shelf 50; therefore, like parts will be identified with numerals increased by 100, with it being understood that the description of the like parts of the first shelf 50 applies to the second shelf 150, unless otherwise noted. The shelf 150 can be substantially identical to the shelf 50, and configured to interact in the same ways with the compartment 14, such as by the at least one mounting structure 162 and the shelf guides 26, and also in that the continuous, raised bead 180 can be formed by the same materials or methods as the continuous, raised bead 80. In one example, the difference between the shelf 150 or the continuous, raised bead 180 and the shelf 50 or the continuous, raised bead 80 can be the shape(s) or pattern(s) defined by the at least one continuous, raised bead 180 and the at least one contour 182.

In the present example, the contour 182 comprises a closed loop pattern, provided more specifically as a closed loop contour 182 comprising a plurality of contours 182. The contour 182 is considered to be a closed loop contour 182 based on the inclusion of at least one closed loop contour 182 that can completely bound an area 176 within the upper surface 174 such that the area 176 is completely fluidly isolated from the peripheral edge 172 or from a separate area 176 by the closed loop contour 182. In one example, the plurality of contours 182 can include contours 182 that can be separate, distinct, or non-continuous with one another, such that a plurality of independent continuous, raised beads 180 form the plurality of contours 182 that bound a plurality of fluidly isolated areas 176 within the upper surface 174, each of the fluidly isolated areas 176 being completely bounded by a corresponding contour 182. Further, at least a portion of the contours 182, and specifically closed loop contours 182, can be provided as a plurality of concentric closed loop contours 182.

It can be seen that the closed loop contour 182 of the shelf 150 includes a plurality of contours 182 or areas 176 that share a border with the peripheral edge 172 and/or with the frame element 160. In one example, the frame element 160 or the peripheral edge 172, or both, can also be configured to prevent liquid that may be present on the shelf 150, and specifically on the support element 170, from flowing past the peripheral edge 172 or the frame element 160 in a manner similar to that of the continuous, raised beads 180 and contours 182, such as, by way of non-limiting example, having a raised height relative to the upper surface 174. In the case that the frame element 160 and the peripheral edge 172 also retain liquid within the upper surface 174, the closed loop contour 182 of the collective extent of the upper surface 174 can be thought of as comprising only closed loop contours 182 that bound fluidly isolated areas 176.

Alternatively, it is contemplated that the frame element 160, or the peripheral edge 172, or both, can be configured such that they do not prevent or restrict liquid from flowing over or beyond them. For example, the support element 170 and the frame element 160 can be coupled such that no liquid seal is formed between them and that liquid that may reach the frame element 160 can pass between the frame element 160 and the support element 170 to reach the peripheral edge 172, and further to overflow the peripheral edge 172. For portions of the perimeter of the support element 170 not contacted by the frame element 160, the peripheral edge 172 can be provided such that liquid reaching the peripheral edge 172 is not prevented from overflowing the peripheral edge 172.

When the peripheral edge 172 or the frame element 160 do not restrict the overflow of liquid, the contour 182 can then be thought of as comprising an overall closed loop contour 182 based on the inclusion of at least one closed loop contour 182, but can further be thought of as comprising a set of open loop continuous, raised beads 180*a* defining a set of open loop contours 182*a* that only partially bound a set of open loop areas 176*a*, as well as a set of closed loop continuous, raised beads 180*b* defining a set of closed loop contours 182*b* that completely bound and fluidly isolate a set of closed loop areas 176*b*. As used herein, the term a set can refer to any suitable number of items, including only a single such item. The open loop contours 182*a* can include and define open channels 184 fluidly coupling the open loop areas 176*a* with the peripheral edge 172. The open loop contours 182*a* can further define contact points 186 where the open loop continuous, raised beads 180*a* terminate at the peripheral edge 172 to comprise an exposed end 186.

Figure 6:
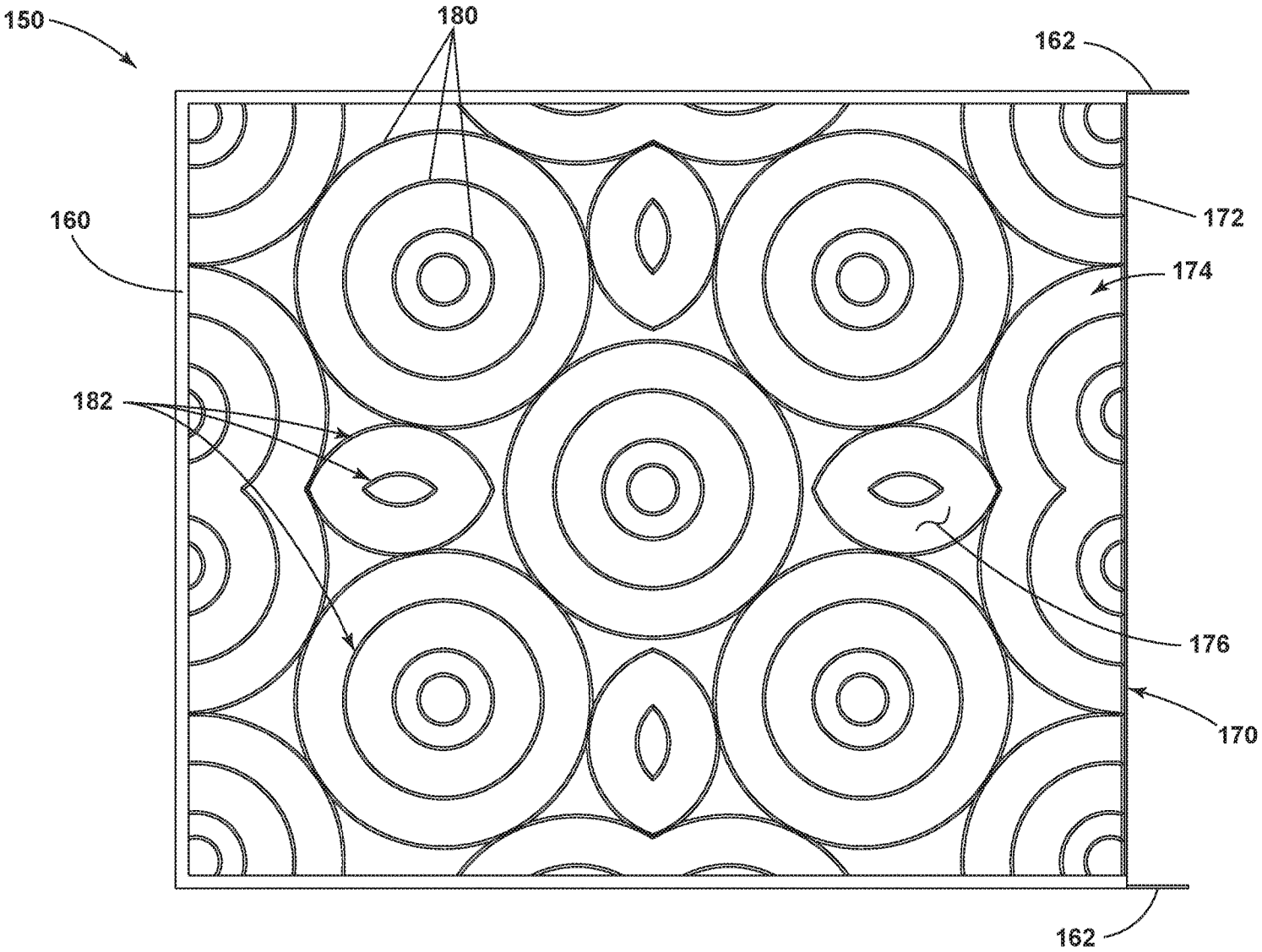
FIG. 6 illustrates a top view of the shelf of FIG. 5.

Referring now to FIG. 6, regardless of whether the frame element 160 and the peripheral edge 172 are configured to prevent or restrict the overflow of liquid to define a closed loop contour 182 comprising only closed loop contours 182 that bound fluidly isolated areas 176 or whether the frame element 160 and the peripheral edge 172 do not prevent or restrict the overflow of liquid, defining a closed loop contour 182 comprising both open loop contours 182*a* that only partially bound open loop areas 176*a* as well as closed loop contours 182*b* that completely bound and fluidly isolate closed loop areas 176*b*, the overall contour 182 extending across the upper surface 174 can be provided to form a pattern that can be aesthetically pleasing or decorative to a user. Any suitable aesthetic pattern can be used, such that the pattern can include open or closed loop contours 182, or a mixture of both. In one example, the pattern defined by the contours 182 can include concentric elements, whether the contours 182 are closed or open loop, or the contours 182 can form a pattern corresponding to a logo or brand indicia. Non-limiting examples of suitable shapes to be included within the contour 182 pattern include circles, ovals, ellipses with rounded or pointed ends, triangles, squares, rectangles with rounded or pointed corners, rhombus, trapezoids, etc.

Figure 7:
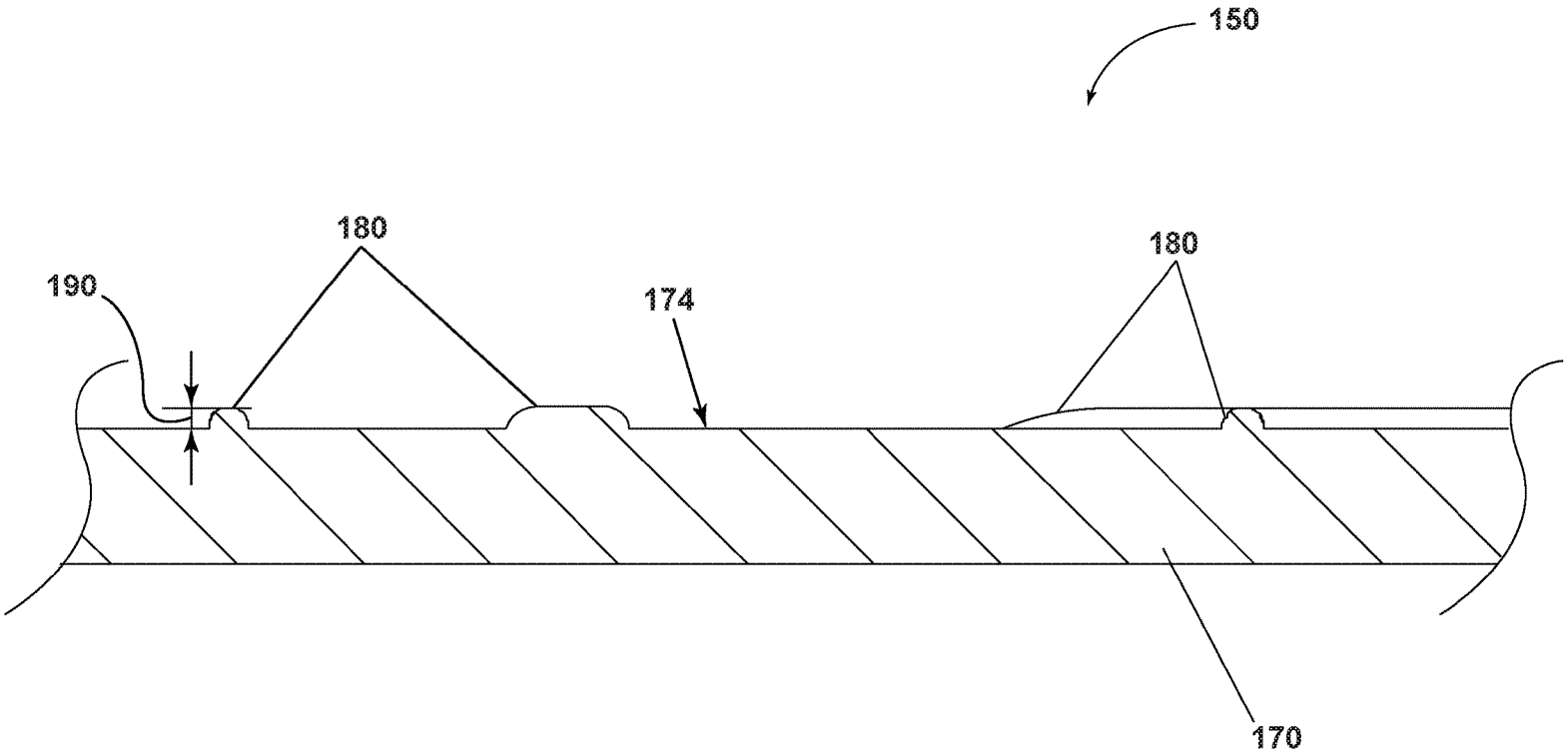
FIG. 7 illustrates a cross-sectional view of the shelf of FIG. 5.

Referring now to FIG. 7, a cross-section of a portion of the shelf 150 illustrates a vertical height 190 of the continuous, raised beads 180 and the contours 182 relative to and extending upwardly from the upper surface 174. The plurality of continuous, raised beads 180 and contours 182 do not have a uniformly spaced cross section as did the shelf 50 of FIG. 4 due to the varied distribution of the shapes of the contours 182. As described previously with respect to the shelf 50, the contours 182 of the shelf 150 can have uniform vertical height 90 throughout the entirety of the contours 182 extending across the upper surface 174, or the vertical height 90 of the contours 182 an vary across the upper surface 174, such as by increasing the vertical height 90 moving towards the peripheral edge 172 of the support element 170.

Turning now to the function of the closed loop contour 182, the pattern or patterns defined by the closed loop contour 182 can be specifically selected to contain and isolate spills that occur on the shelf 150. Because at least a portion of the contours 182 completely bound and fluidly isolate areas 176 within the upper surface 174 from the peripheral edge 172 or from other areas 176, the closed loop contour 182 is at least partially configured to isolate and contain a spill within the area 176, rather than allowing the liquid to spread across a larger portion of the upper surface 174. While the open loop contour 82 is configured to guide liquid within the open loop contour 82 to spread out in order to avoid the liquid overflowing the open loop contour 82 and soiling containers 30 or food items resting on the open loop contour 82, the closed loop contour 182 is instead configured to contain and isolate liquid within the smaller areas 176 in order to minimize the surface area of the upper surface 174 that may be exposed to the spill.

By providing closed loop contours 182 that bound areas 176 smaller than the surface area of the upper surface 174, a volume of a spill or liquid that is required to exceed the vertical height 90 of the closed loop contours 182 and to overflow the closed loop contours 182 is reduced as compared to the volume of liquid that would be required to overflow the open loop contour 82. Thus, a smaller spill or a smaller volume of liquid on the shelf 150 can result in soiling of the containers 30 or food items resting on the closed loop contours 182 as compared to that for containers 30 or food items resting on the open loop contour 82 of the shelf 50.

On the other hand, while the open loop contour 82 of the shelf 50 was configured to guide the liquid to spread out along the open loop contour 82 and along the upper surface 174, the closed loop contour 182 of the shelf 150 can slow the spread of a liquid or spill because the spilled liquid has to fill and then overflow a plurality of closed loop contours 182 sequentially to continue spreading out across the upper surface 174, rather than drawing the liquid across the upper surface 74 by capillary action as in the open loop contour 82. It is contemplated that providing the closed loop contour 182 comprising both open loop contours 182*a* and closed loop contours 182*b* can provide an overall contour 182 that is configured both to slow the spread of a liquid by containing and isolating the liquid within closed loop contours 182*b*, as well as by preventing overflow that can soil containers 30 and food items that rest upon the open loop contours 182*a*. By including contours 182 providing both the closed loop and open loop liquid containment functions, liquid containment can be optimized to provide a balance of containing and isolating spills with guiding spills in order to avoid overflow.

Figure 8:
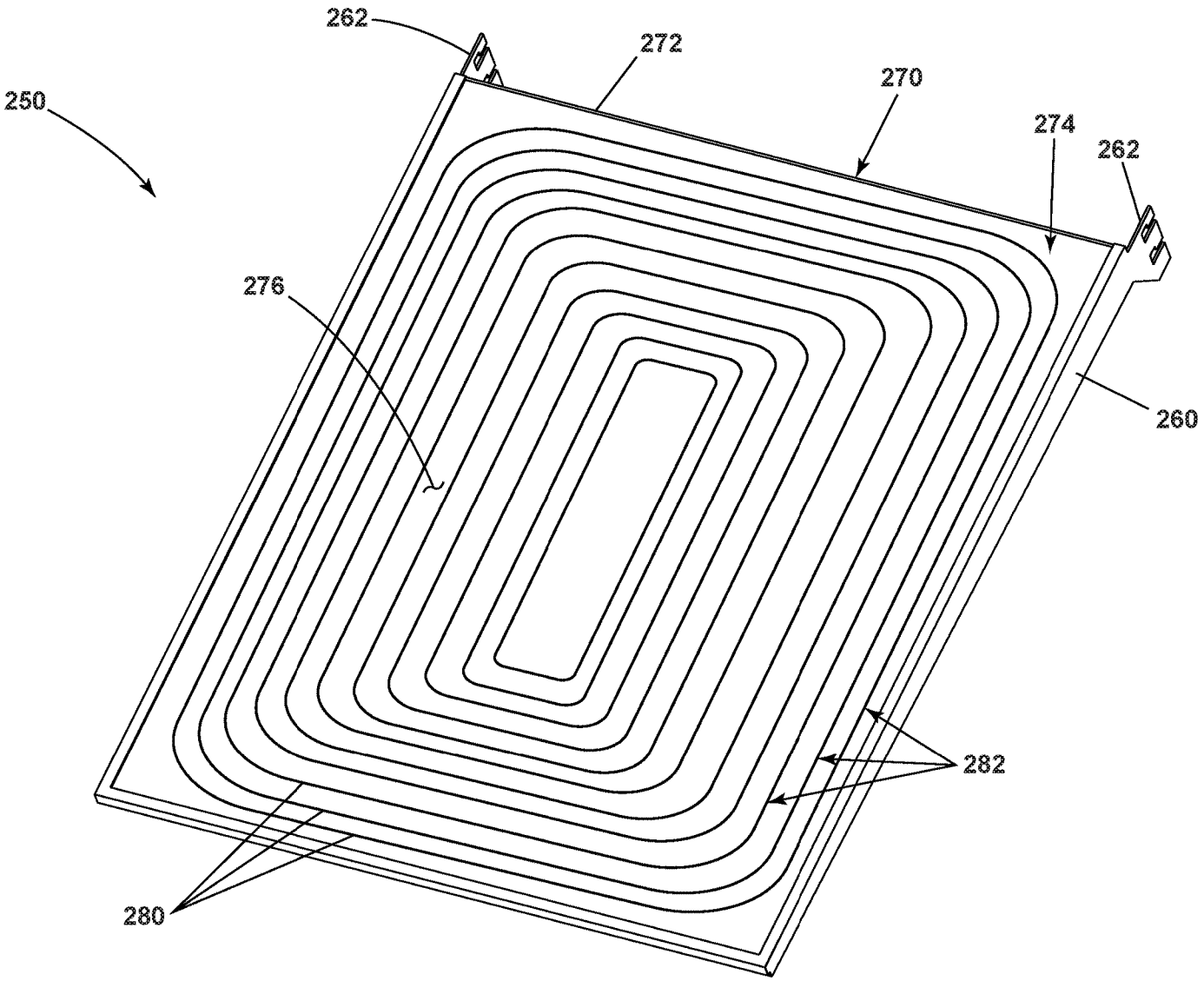
FIG. 8 illustrates a perspective view of another example of a shelf that can be provided within the refrigerator of FIG. 1.

Referring now to FIG. 8, another example of a shelf 250 that can include at least one continuous, raised bead 280 that individually and/or collectively define a contour 282 that can extend across at least a portion of the upper surface 274 is illustrated. The shelf 250 is similar to the first shelf 50; therefore, like parts will be identified with numerals increased by 200, with it being understood that the description of the like parts of the first shelf 50 applies to the third shelf 250, unless otherwise noted. The shelf 250 can further be similar to the second shelf 150; therefore, it will be understood that the description of the like parts of the second shelf 150 also applies to the third shelf 250, unless otherwise noted. The shelf 250 can be substantially identical to the shelves 50, 150, and configured to interact in the same ways with the compartment 14, such as by the at least one mounting structure 262 and the shelf guides 26, and also in that the continuous, raised bead 280 can be formed by the same materials or methods as the continuous, raised beads 80, 180. In one example, the difference between the shelf 250 or the continuous, raised bead 280 and the shelves 50, 150 or the continuous, raised beads 80, 180 can be the shape(s) or pattern(s) defined by the at least one continuous, raised bead 280 and the at least one contour 282.

In the present example, the contour 282 comprises a closed loop pattern, provided more specifically as an entirely closed loop contour 282 comprising a plurality of concentric closed loop contours 282. The contour 282 is considered to be a closed loop contour 282 based on the inclusion of at least one closed loop contour 282 that can completely bound an area 276 within the upper surface 274 such that the area 276 is completely fluidly isolated from the peripheral edge 272 or from another of the areas 276 by the closed loop contour 282. It will also be understood that the closed loop contour 282 can comprise only closed loop contours 282 configured to contain and isolate liquid on the upper surface 274. Further, the only closed loop contours 282 can be provided such that all of the closed loop contours 282 are provided concentrically.

In one example, the plurality of contours 282 can include contours 282 that can be separate, distinct, or non-continuous with one another, such that a plurality of independent continuous, raised beads 280 form the plurality of closed loop contours 282 that each completely bound a fluidly isolated area 276 within the upper surface 274. In addition, in the closed loop contour 282, each of the continuous, raised beads 280 can be provided as a single continuous, raised bead 280 forming the entire closed loop contour 282, though it will be understood that more than one continuous, raised bead 280 can form each of the closed loop contours 282. The closed loop contour 282, and in particular as an entirely closed loop contour 282, can be provided such that the closed loop contours 282, both individually and optionally collectively, completely fluidly isolate the areas 276 from the peripheral edge 272 or the frame element 260.

Figure 9:
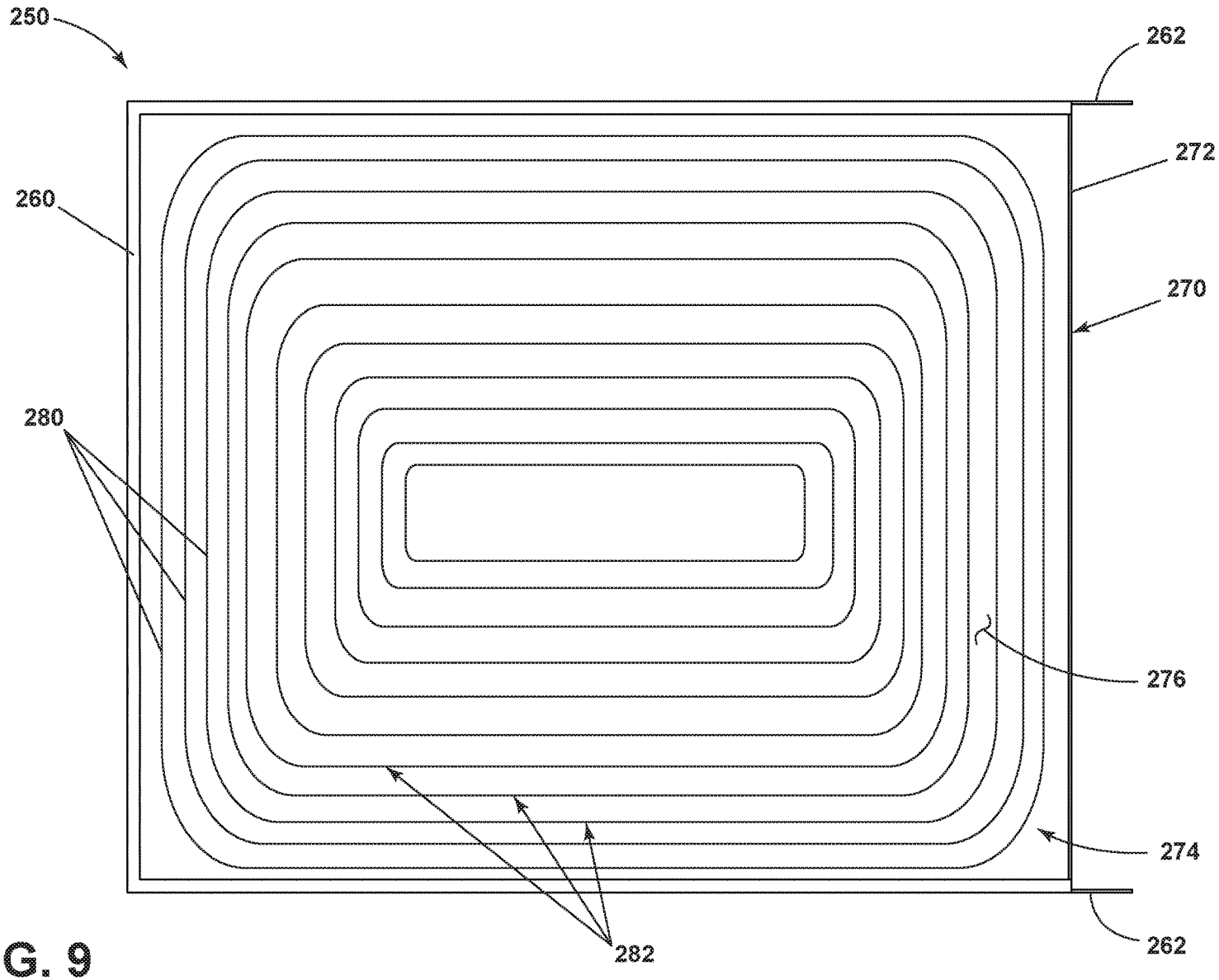
FIG. 9 illustrates a top view of the shelf of FIG. 8.

Referring now to FIG. 9, the closed loop contour 282 can be provided entirely interiorly of the peripheral edge 272 such that the continuous, raised beads 280 and the closed loop contour 282 do not contact or directly abut the peripheral edge 272. However, it will be understood that the closed loop contour 282 can extend across any desired portion, proportion, or percentage of the surface area of the upper surface 274, including across at least the majority of the surface area of the upper surface 274, and in any desired pattern, geometric, aesthetic, or decorative, and whether distributed uniformly or non-uniformly across the upper surface 74. Further, while the closed loop contour 282 is illustrated herein as a substantially rectangular-shaped concentric pattern, with the rectangles having rounded corners, it will be understood that any suitable shape profile can be used for the closed loop contour 282, non-limiting examples of which include a completely rectangular-shaped concentric pattern, a circular concentric pattern, or concentric or non-concentric circles, ovals, ellipses with rounded or pointed ends, triangles, squares, rectangles with rounded or pointed corners, rhombus, trapezoids, etc.

The closed loop contour 282 can define a vertical height 290 relative to the upper surface 274, uniform or non-uniform across the upper surface 274, as described with respect to the closed loop contour 182 having vertical height 190. Turning now to the function of the closed loop contour 282, the pattern or patterns defined by the closed loop contour 282 can be specifically selected to contain and isolate liquid present on the support element 270 in the same manner as previously described with respect to the closed loop contours 182, 182*b* of FIG. 7. Specifically, the closed loop contours 282 are configured to contain and isolate liquid within the areas 276 such that the overflow of liquid from one closed loop contour 282 to the next slows the spread of the liquid and can contain and isolate the liquid within a smaller surface area of the upper surface 274 as compared to the open loop contour 82.

The aspects of the present disclosure as described herein set forth refrigerator shelves that can be configured for improved spill containment function through the use of at least one continuous, raised bead defining the contour while still providing a stable surface upon which food items and containers can be supported. The various aspects described herein offer flexible options such that spills can be either contained and isolated within a smaller surface area or that spills can be guided along an open loop contour to spread out across the surface in order to avoid the soiling of food items or the undersides of containers that may be resting upon the contours, or further that a shelf can include sets of contours configured to provide each of the alternate spill containment functions for an optimized mix of spill containment strategies.

These aspects allow for spilled or leaked liquids to be managed in such a way that can minimize a mess or provide an easier cleaning process for a user by isolating, containing, or guiding a liquid and by minimizing soiling of containers by providing a support surface that extends upwardly from the upper surface of the shelf upon which liquid collects that can support the containers at a height above that of the liquid. Further, the shelves described herein can provide robust contours that stand up to wear and can even provide additional functionality to the shelves, such as by providing illumination to the contour and to the shelf. Such illumination can be decorative, can include at least one color, and can include UV illumination for improved freshness within the refrigerator.

While the use of the glass shelf has been described herein within the context of a refrigerating appliance, it will be understood that the present disclosure is applicable to any appliance for the storage of food substances, whether the temperature within the food storage appliance is regulated or stored at a temperature different from the external environment of the appliance or at a temperature that is the same as the external environment of the appliance, and further whether the appliance stores the food substances at a temperature that is lower or higher than the external environment if the temperature is not the same as the external environment of the appliance. Non-limiting examples of such an appliance for the storage of food substances include a storage or refrigerating cabinet, a storage or refrigerating drawer, a beverage storing appliance, such as for wine, spirits, liqueurs, etc., or a wine cellar.

To the extent not already described, the different features and structures of the various aspects can be used in combination with each other as desired. That one feature may not be illustrated in all of the aspects of the disclosure is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While the aspects of the present disclosure have been specifically described in connection with certain specific details thereof, it is to be understood that this is by way of illustration and not of limitation. Reasonable variation and modification are possible within the scope of the forgoing disclosure and drawings without departing from the spirit of the present disclosure, which is defined in the appended claims. Hence, specific dimensions and other physical characteristics relating to the aspects of the present disclosure are not to be considered as limiting, unless expressly stated otherwise.

What is claimed is:

1. A refrigerator comprising:

at least one compartment having an open face;

a closure movable relative to the open face to selectively close the open face;

at least one annealed glass shelf provided within the compartment and having an upper surface; and at least one continuous, raised bead of ceramic paint provided on the upper surface and defining a contour at least partially bounding an area within the upper surface, the contour comprising an open loop pattern configured to guide spills to spread across the shelf.

2. The refrigerator of claim 1 wherein the annealed glass shelf is not yet tempered when the at least one continuous, raised bead of ceramic paint is provided onto the upper surface.

3. The refrigerator of claim 1 wherein the annealed glass shelf has a peripheral edge defining a boundary and the contour is positioned interiorly of the peripheral edge.

4. The refrigerator of claim 1 wherein the contour comprises a closed loop pattern configured to contain and isolate spills on the shelf.

5. The refrigerator of claim 4 wherein the closed loop pattern comprises a plurality of concentric closed loop contours.

6. The refrigerator of claim 1 wherein the open loop pattern comprises a spiral-shaped open loop contour.

7. The refrigerator of claim 1 wherein the contour defines a vertical height extending from the upper surface and the vertical height of the contour is uniform across the entire shelf.

8. The refrigerator of claim 1 wherein the contour defines a vertical height extending from the upper surface and the vertical height of the contour increases towards a periphery of the shelf.

9. The refrigerator of claim 1 further comprising a drawer slidably mounted beneath the shelf such that the shelf selectively closes the drawer.

10. A refrigerator comprising:

at least one compartment having an open face;

a closure movable relative to the open face to selectively close the open face;

at least one glass shelf provided within the compartment and having an upper surface; and at least one continuous, raised bead provided on the upper surface and defining a contour at least partially bounding an area within the upper surface, the at least one continuous, raised bead comprising at least one optical glass fiber configured to provide illumination to the at least one continuous, raised bead.

11. The refrigerator of claim 10 wherein the illumination provided by the optical glass fiber includes at least one color of the visible light spectrum.

12. The refrigerator of claim 10 wherein the illumination provided by the optical glass fiber includes ultraviolet (UV) illumination.

13. The refrigerator of claim 10 wherein the glass shelf has a peripheral edge defining a boundary and the contour is positioned interiorly of the peripheral edge.

14. The refrigerator of claim 10 wherein the contour comprises a closed loop pattern configured to contain and isolate spills on the shelf.

15. The refrigerator of claim 10 wherein the contour comprises an open loop pattern configured to guide spills to spread across the shelf.

16. The refrigerator of claim 10 wherein the contour defines a vertical height extending from the upper surface and the vertical height of the contour is uniform across the entire shelf.

17. The refrigerator of claim 10 wherein the contour defines a vertical height extending from the upper surface and the vertical height of the contour increases towards a periphery of the shelf.

18. The refrigerator of claim 10 further comprising a drawer slidably mounted beneath the shelf such that the shelf selectively closes the drawer.

19. A refrigerator comprising:

at least one compartment having an open face;

a closure movable relative to the open face to selectively close the open face;

at least one shelf provided within the compartment and having an upper surface; and at least one continuous, raised bead provided on the upper surface and defining a contour at least partially bounding an area within the upper surface, the contour comprising an open loop pattern configured to guide spills to spread across the shelf.

20. The refrigerator of claim 19 wherein the open loop pattern comprises a spiral-shaped open loop contour.

* * * * *